US008104167B2

(12) United States Patent
Lin

(10) Patent No.: US 8,104,167 B2
(45) Date of Patent: Jan. 31, 2012

(54) METHOD OF MANUFACTURING RESISTANCE FILM HEATING APPARATUS

(75) Inventor: I Feng Lin, Kowloon (HK)

(73) Assignee: Mun Ling Leung, Kowloon (HK)

( * ) Notice: Subject to any disclaimer, the term of this patent is extended or adjusted under 35 U.S.C. 154(b) by 889 days.

(21) Appl. No.: 12/159,203

(22) PCT Filed: Apr. 21, 2006

(86) PCT No.: PCT/CN2006/000765

§ 371 (c)(1),
(2), (4) Date: Jun. 25, 2008

(87) PCT Pub. No.: WO2007/073636

PCT Pub. Date: Jul. 5, 2007

(65) Prior Publication Data

US 2008/0308549 A1 Dec. 18, 2008

(30) Foreign Application Priority Data

Dec. 29, 2005 (CN) ..... 2005 1 0137525

(51) Int. Cl.
*H05B 3/00* (2006.01)

(52) U.S. Cl. ..... 29/611; 29/613; 29/620; 219/543; 219/546

(58) Field of Classification Search ..... 29/611, 29/610.1, 613, 620, 621; 219/444.1, 543, 219/546, 548; 338/307–310
See application file for complete search history.

(56) References Cited

U.S. PATENT DOCUMENTS 6,486,447 B2 * 11/2002 Miyata ..... 219/444.1
6,878,907 B2 * 4/2005 Hiramatsu et al. ..... 219/444.1

FOREIGN PATENT DOCUMENTS

CN 1174487 2/1998
JP 2001-237052 8/2001

* cited by examiner

*Primary Examiner* — Thiem Phan
(74) *Attorney, Agent, or Firm* — J.C. Patents

(57) ABSTRACT

A method of manufacturing a resistance film heating apparatus comprising: acid washing and cleaning the surface of a base material; heating and activating the base material; spraying a liquid resistance material on the surface; testing by the four-point method the actual heating power of the surface high-density resistance film on the cooled down base material in accord with a designed heating power, and correcting the characteristics of the designed conductive electrodes, thereby ensuring that the heating power is with the designed heating power; printing the corrected value of conductive silver slurry in a predetermined manner on the base material; sintering and solidifying the conductive silver slurry in a baking process so as to form electrodes; testing again after the electrodes cooling down naturally, and mending the electrodes using the conductive silver slurry and adjusting the baking temperature in accord with the designed heating power, and forming an eligible finished product.

3 Claims, 7 Drawing Sheets

METHOD OF MANUFACTURING RESISTANCE FILM HEATING APPARATUS

CROSS-REFERENCE TO RELATED APPLICATIONS

This application is a national phase application of international application No. PCT/CN2006/000765 filed on Apr. 21, 2006, which claims the priority benefits of China patent application No. 200510137525.0 filed on Dec. 29, 2005. The contents of the above prior applications are hereby incorporated by reference in their entirety.

TECHNICAL FIELD

The present invention relates to a method of manufacturing a heating apparatus and a heating apparatus formed by the same, and in particular to a method of manufacturing a high-density resistance film heating apparatus and a resistance film heating apparatus formed by the same.

BACKGROUND ART

As a new-type surface heating technique, the resistance film heating technique has been widely used in forming heating apparatus in combination with such base material as glass, ceramic or enamel in recent years. However, the components and manufacturing process of the current resistance film heating apparatus in the prior art often give rise to the following defects: the upper limit of heating temperature is restricted not to exceed 400° C.; the base material is readily burned-out due to the serious problem of hot spot; the power attenuates severely, e.g. the heating power will attenuate by almost a half within one month; it is difficult to control the power or to adjust the heating temperature; the electrode is easily burned-out; it is difficult to manufacture in batches.

SUMMARY OF THE INVENTION

In order to solve the problems existing in the prior art, the object of the present invention is to provide a resistance film heating apparatus having good heating effect, being durable and able to be manufactured in batches and a method of manufacturing the same.

The object of the present invention is implemented in such a way, i.e. to provide a method of manufacturing a resistance film heating apparatus, which includes the following steps: (1) preparing the liquid resistance material according to the designed heating power of the resistance film heating apparatus to be manufactured; (2) acid washing the surface of the base material; (3) cleaning the washed surface of the base material; (4) heating the base material in a high-temperature furnace up to 500° C.-800° C. so as to activate the surface of the base material; (5) spraying the liquid resistance material on the surface of the base material so as to form a surface high-density resistance film having predetermined shape; (6) after the base material cooling down naturally, testing by the four-point method whether the actual heating power of the surface high-density resistance film on the base material is in accord with the designed heating power, and correcting the spacing, size, shape and baking temperature of the designed conductive electrodes, thereby ensuring that the heating power is in accord with the designed heating power; (7) printing the conductive silver slurry in a predetermined manner on the base material according to the calculated correction value; (8) sintering and solidifying the conductive silver slurry by backing it at a temperature of 350° C.-650° C. so as to form electrodes; (9) after the electrodes cooling down naturally, testing again the actual heating power with the addition of electrodes, and mending the electrodes by using the conductive silver slurry and adjusting the baking temperature of the electrodes again if the actual heating power is yet not in accord with the designed heating power, and then returning to step (8); and, if it is in accord with the designed heating power, forming an eligible finished product of resistance film heating apparatus.

In a preferred embodiment of the present invention, the step of cleaning the washed surface of the base material comprises cleaning with ultrasonic, absolute alcohol or isopropyl alcohol.

If the selected base material is of conductive materials, a layer of insulating medium is applied on the surface of the base material before the step of activating the surface.

The present invention also provides the resistance film heating apparatus manufactured by the same method.

The resistance film heating apparatus manufactured by the method of the present invention has stable and durable performance, in which the heating temperature is up to 600° C. and the power density is up to 20 W/cm$^2$.

BRIEF DESCRIPTION OF THE DRAWINGS

The present invention is described in detail with reference to the following drawings.

FIGS. 3-10 are schematic views of different ways of arranging the resistance film and the electrodes of the resistance film heating apparatus of the present invention, wherein

PREFERRED MODE FOR CARRYING OUT THE INVENTION

Figure 1:
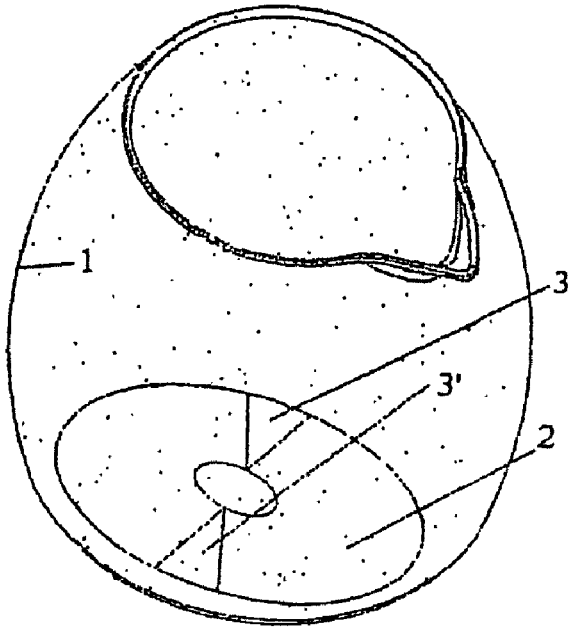
FIGS. 1-2 are schematic views of different embodiments of the resistance film heating apparatus of the present invention.
Figure 2:
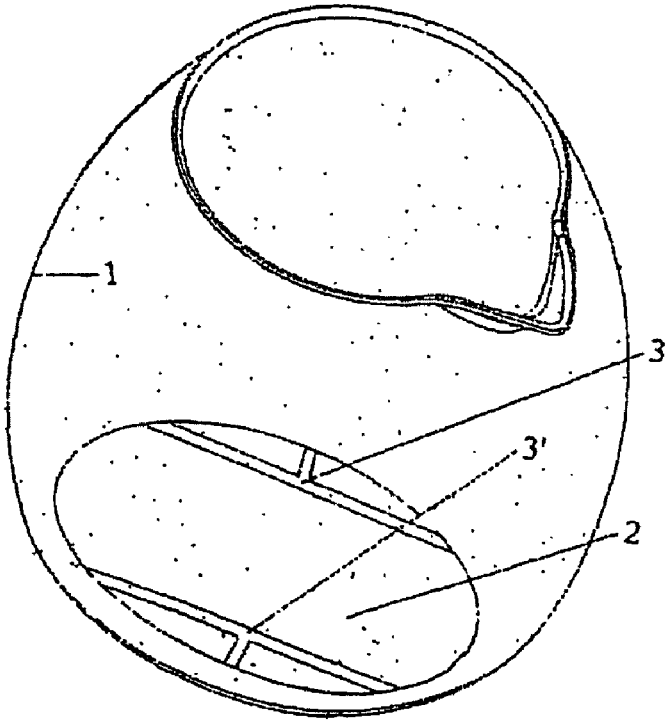
Figure 3:
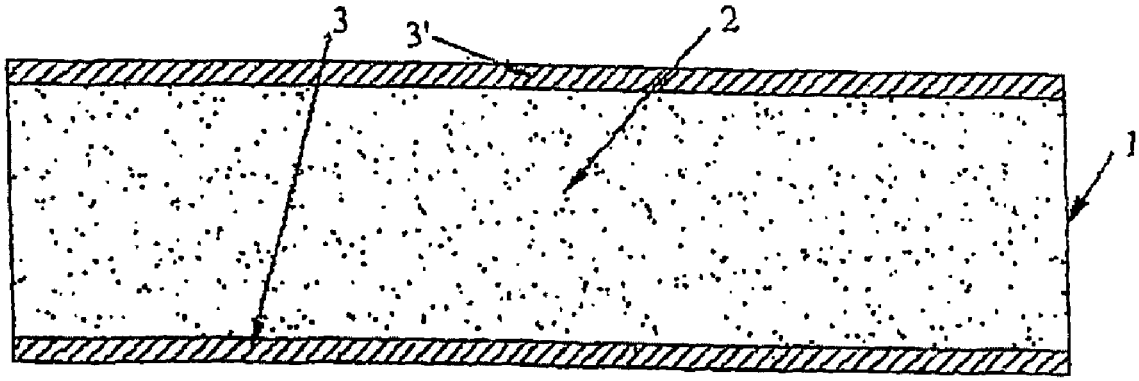
Figure 4:
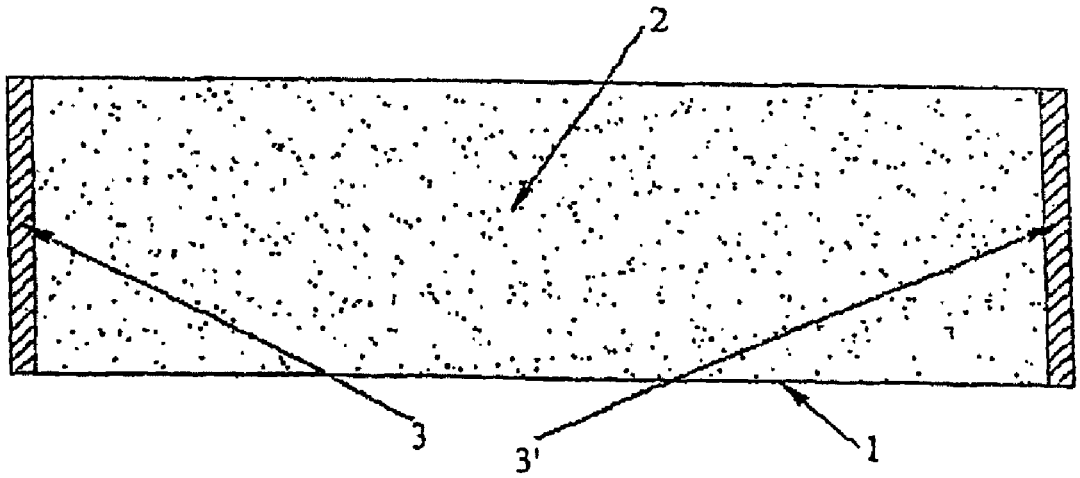
Figure 5:
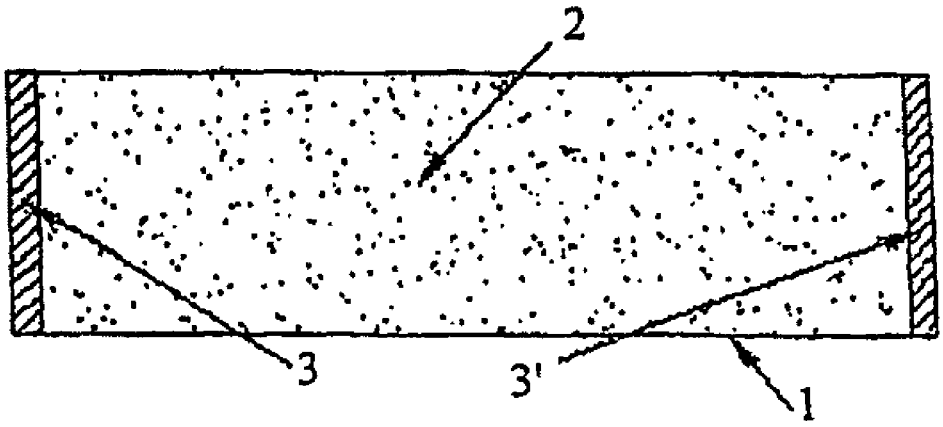
Figure 5A:
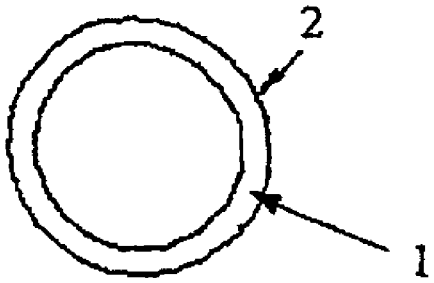
FIG. 5A is a side view of FIG. 5
Figure 6:
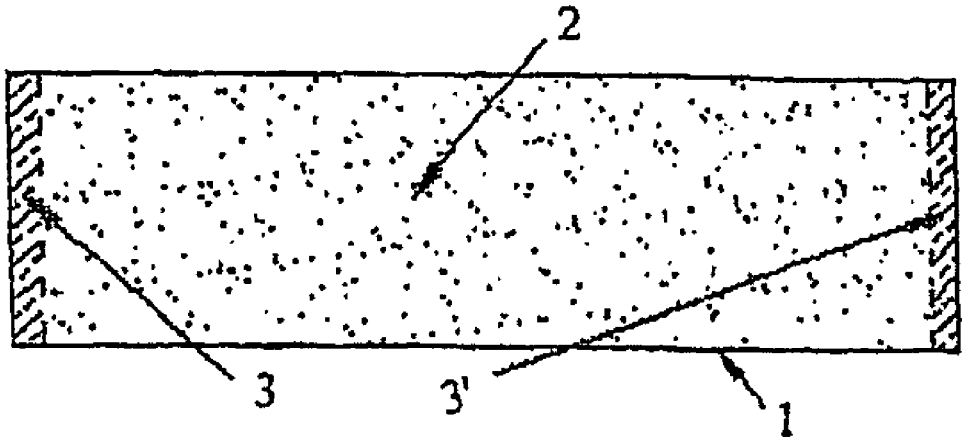
Figure 6A:
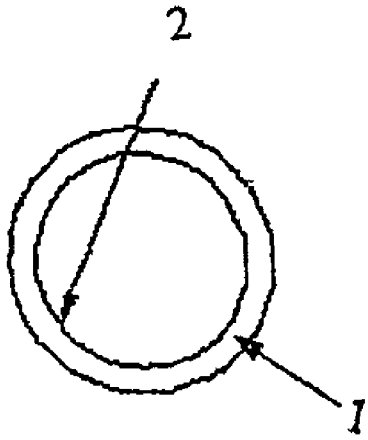
FIG. 6A is a side view of FIG. 6.
Figure 7:
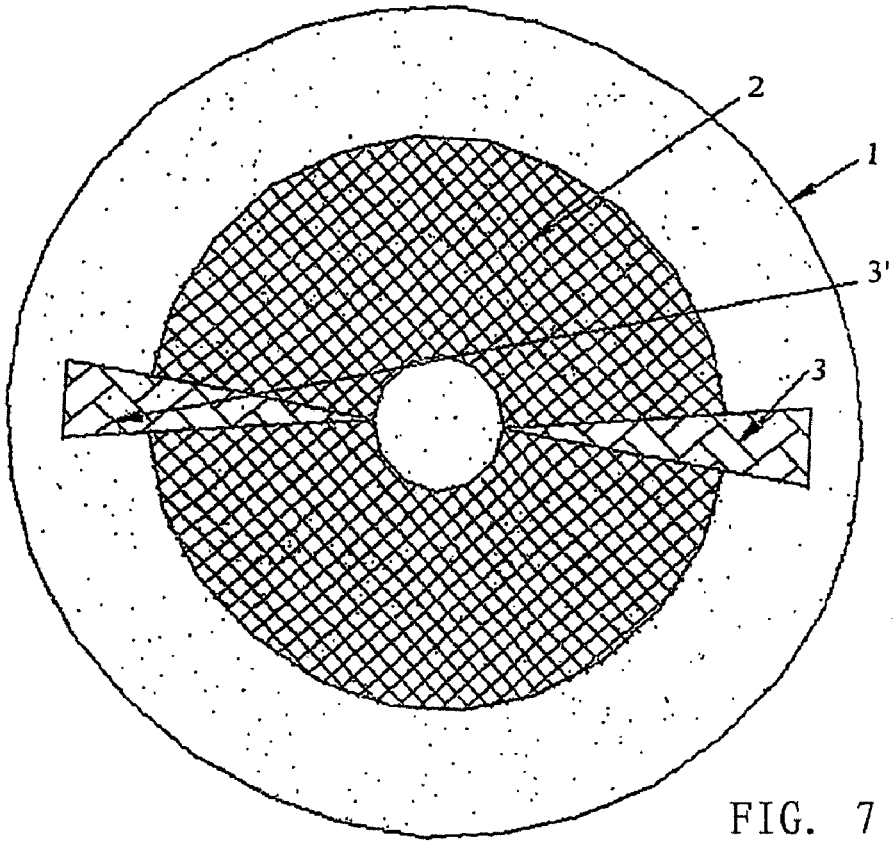
Figure 8:
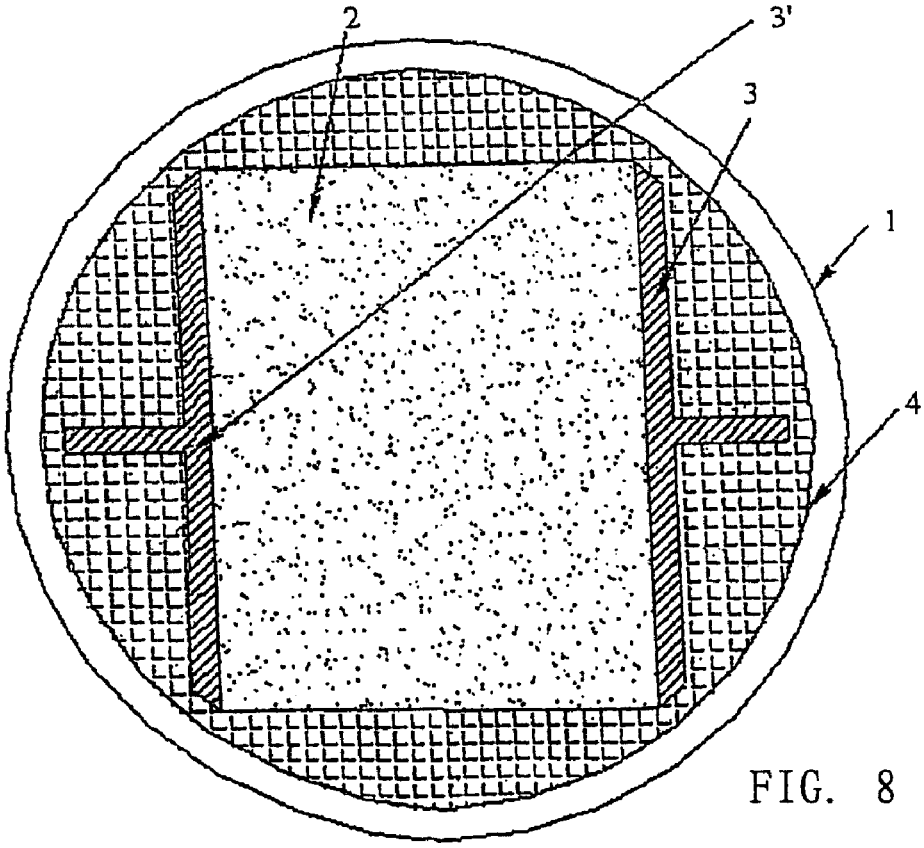
Figure 9:
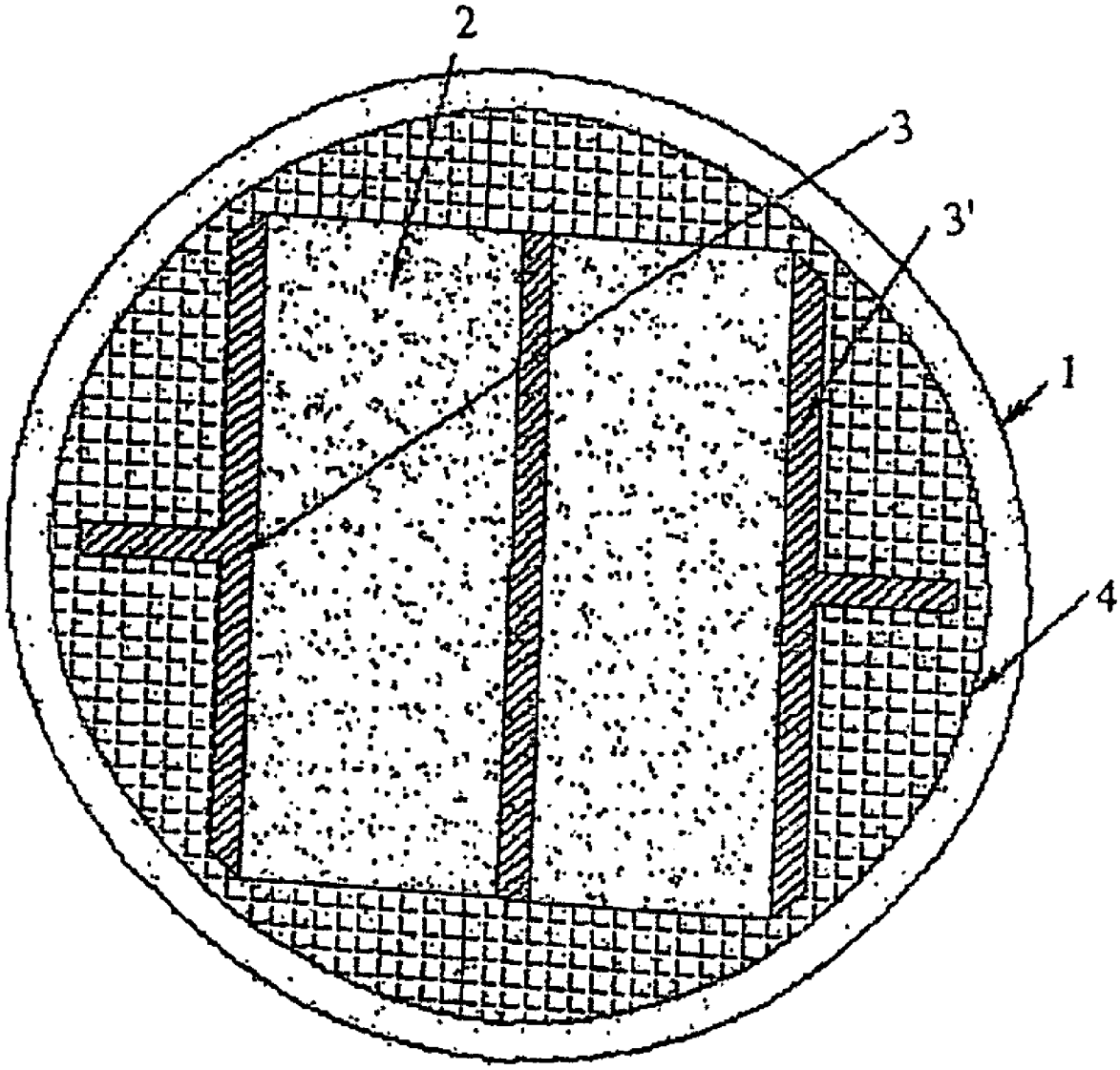
Figure 10:
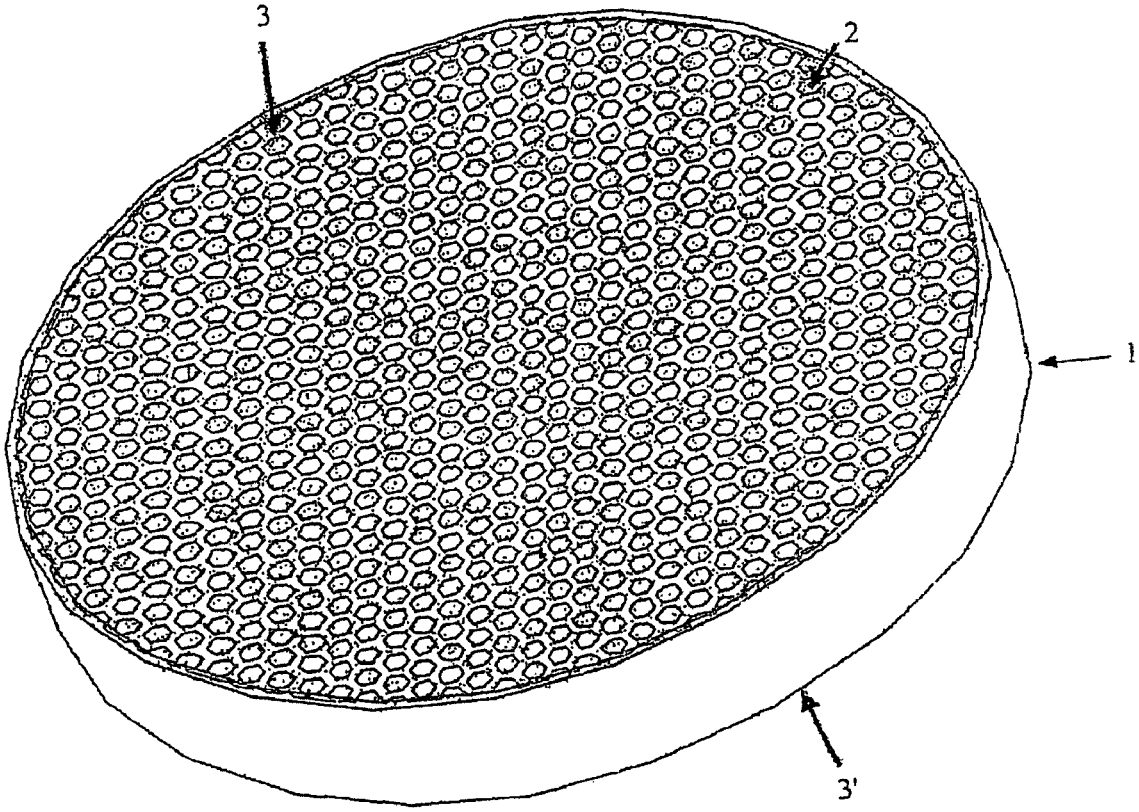

FIGS. 1-2 show the schematic views of different embodiments of the resistance film heating apparatus of the present invention. In these embodiments, the base material 1 to be selected is glass. Of course, ceramic, enamel or metal vessels can be used as the base material.

Firstly, the liquid resistance material is prepared according to the designed heating power of the resistance film heating apparatus to be manufactured. The resistance material mainly comprises compound of Sn, In or Ti in the proportion of about 49.5 weight %, water and alcohol of about 49.5 weight % and compound of B, Sb or Ca of about 1 weight %. Those skilled in the art can appropriately adjust the proportions of the components according to the desired heating power so as to meet the requirement of design.

Next, the surface of the base material is acid washed by using various conventional washing reagents, for example, diluted sulfuric acid. Then the surface of the base material is passivated so that the resistance material can be fixedly attached to the surface of the base material during the following procedures.

The washed base material 1 needs to go through a cleaning process so as to remove the remaining washing reagent from the surface of the base material. The cleaning method includes cleaning with ultrasonic, absolute alcohol or isopropyl alcohol.

If the base material 1 is made of conductive materials, a step of applying insulating medium is added after the step of cleaning, which insulating medium may be a layer of ceramic or enamel material.

Subsequently, the base material 1 is heated in a high-temperature furnace so as to activate the surface of the base material. The heating temperature is 500° C.-800° C., and the activating temperature can vary according to the different materials of the base material 1. Normally, the activating temperature for enamel material is 580° C.-650° C., for glass material is 530° C.-620° C., for monocrystal glass is 650° C.-700° C., and for ceramic material is 500° C.-550° C. When the base material is of metal materials, the activating temperature is determined according to the material of the insulating medium.

The prepared liquid resistance material is sprayed the on the activated object surface of the base material 1 so as to form a surface high-density resistance film 2 having predetermined shape.

After the base material coated with resistance film cools down naturally, the actual heating power of the surface high-density resistance film on the base material is tested by the four-point method to see whether it is in accord with the designed heating power, and then the spacing, size, shape and baking temperature of the designed conductive electrodes are calculated according to the actual measured value and the designed pattern of the conductive electrodes, thereby ensuring that the heating power is in accord with the designed heating power.

According to the calculated parameters such as size, shape and spacing, the conductive silver slurry is printed on the base material 1. Said semi-finished product is send into an electrode processing furnace for being baked at the temperature of 350° C.-650° C. such that the silver slurry is sintered and solidified to form electrodes 3 and 3'. After the electrodes cools down naturally, the actual heating power with the addition of electrodes is tested again. If the actual heating power is yet not in accord with the designed heating power, the electrodes are again mended by the correcting method using the conductive silver slurry and the baking temperature of the electrodes is adjusted. The electrodes are returned to the furnace to be baked at the corrected baking temperature so as to sinter and solidify the conductive silver slurry for mending. The testing step is repeated until the actual heating power is in accord with the designed power.

In this way, a high-density resistance film heating apparatus is formed.

FIGS. 3-10 show the schematic views of different ways of arranging the resistance film and the electrodes of the resistance film heating apparatus of the present invention, wherein the base material of the resistance film heating apparatus as shown in FIGS. 5 and 5A and FIGS. 6 and 6A is a tubular article. The electrodes of the resistance film heating apparatus can be more than two. By selecting two of the electrodes as the working electrode, it can be realized to adjust the heating power by means of different series connection of resistance.

Due to the stable performance of the resistance film layer, the resistance film heating apparatus manufactured by the method of the present invention has a service life of more than 4000 hours and a heating temperature of more than 400° C., which totally overcomes the problem of power attenuation in the prior arts.

Although the invention has been described with reference to the preferred embodiments, the present invention is not limited to this. It is to be understood that many other possible modifications and variations can be made by those skilled in the art without departing from the spirit and scope of the invention.

What is claimed is:

1. A method of manufacturing a resistance film heating apparatus, characterized in that it includes the following steps:

(1) preparing a liquid resistance material according to the designed heating power of the resistance film heating apparatus to be manufactured;

(2) acid washing the surface of a base material;

(3) cleaning the washed surface of the base material;

(4) heating the base material in a high-temperature furnace up to 500° C.-800° C. so as to activate the surface of the base material;

(5) spraying the liquid resistance material onto the surface of the base material so as to form a surface high-density resistance film having a predetermined shape;

(6) after the base material cooling down naturally, testing with the four-point method whether the actual heating power of the surface high-density resistance film on the base material is in accord with the designed heating power, and correcting the spacing, size, shape and baking temperature of the designed conductive electrodes, thereby ensuring that the heating power is in accord with the designed heating power;

(7) printing a conductive silver slurry in a predetermined manner on the base material according to the calculated correction value;

(8) sintering and solidifying the conductive silver slurry by backing it at a temperature of 350° C.-650° C. so as to form electrodes;

(9) after the electrodes cooling down naturally, testing again the actual heating power with the addition of electrodes, and mending the electrodes by using the conductive silver slurry and adjusting the baking temperature of the electrodes again if the actual heating power is yet not in accord with the designed heating power, and then returning to step (8); and, if it is in accord with the designed heating power, forming an eligible finished product of resistance film heating apparatus.

2. The method of manufacturing a resistance film heating apparatus according to claim 1, characterized in that the step of cleaning the washed surface of the base material comprises cleaning with ultrasonic, absolute alcohol or isopropyl alcohol.

3. The method of manufacturing a resistance film heating apparatus according to claim 1, characterized in that a layer of insulating medium is applied onto the surface of the base material before the step of activating the surface if the selected base material is of conductive materials.

* * * * *